US010349178B2

(12) United States Patent
Lettow et al.

(10) Patent No.: US 10,349,178 B2
(45) Date of Patent: Jul. 9, 2019

(54) MICROPHONE DIAPHRAGM

(71) Applicant: VORBECK MATERIALS CORP., Jessup, MD (US)

(72) Inventors: John S Lettow, Washington, DC (US); Dan F Scheffer, Frederick, MD (US); Kenneth E Fritsch, Arnold, MD (US)

(73) Assignee: VORBECK MATERIALS, CORP., Jessup, MD (US)

( * ) Notice: Subject to any disclaimer, the term of this patent is extended or adjusted under 35 U.S.C. 154(b) by 296 days.

(21) Appl. No.: 14/995,286

(22) Filed: Jan. 14, 2016

(65) Prior Publication Data

US 2017/0013361 A1 Jan. 12, 2017

Related U.S. Application Data

(60) Provisional application No. 62/099,504, filed on Jan. 3, 2015.

(51) Int. Cl.

| | |
|---|---|
| ***H04R 7/00*** | (2006.01) |
| ***H04R 7/06*** | (2006.01) |
| ***H04R 23/02*** | (2006.01) |
| ***H04R 23/00*** | (2006.01) |
| ***H04R 31/00*** | (2006.01) |
| ***H04S 7/00*** | (2006.01) |

(52) U.S. Cl.

CPC ..... *H04R 7/06* (2013.01); *H04R 23/008* (2013.01); *H04R 23/02* (2013.01); *H04R 31/003* (2013.01); *H04S 7/00* (2013.01); *H04R 2307/023* (2013.01); *H04R 2307/027* (2013.01); *H04S 2420/01* (2013.01)

(58) Field of Classification Search

CPC ..... H04R 7/00; H04R 23/00; H04R 31/00; H04R 2307/00; H04S 7/00; H04S 2420/00; B41M 7/00; C09D 5/00; H01B 1/00

See application file for complete search history.

(56) References Cited

U.S. PATENT DOCUMENTS

| | | | | |
|---|---|---|---|---|
| 2010/0188796 | A1* | 7/2010 | Bulovic | B81C 1/0046 361/280 |
| 2011/0075865 | A1* | 3/2011 | Yang | H04R 19/005 381/174 |
| 2012/0103670 | A1* | 5/2012 | Lettow | B82Y 30/00 174/258 |
| 2015/0098606 | A1* | 4/2015 | Akino | H04R 7/18 381/398 |

FOREIGN PATENT DOCUMENTS

WO 2012/068182 A1 * 5/2012

* cited by examiner

*Primary Examiner* — Gordon Baldwin
*Assistant Examiner* — Mohammad Mayy
(74) *Attorney, Agent, or Firm* — Trentice V. Bolar, Esq.

(57) ABSTRACT

Embodiments of the present invention relate to microphones diaphragms. In one embodiment, a sensor comprising a diaphragm comprised of a composition having a plurality of individual graphene sheets. An emitter formed in a manner to transmit lights towards a surface of the diaphragm. A collector that captures at least a portion of light that is reflected by the diaphragm. A converter is in communication with the detector that converts a signal that is generated by the sensor to a digital signal for processing. The graphene-based composition includes graphene sheets.

6 Claims, 3 Drawing Sheets

MICROPHONE DIAPHRAGM

CROSS-REFERENCE TO RELATED APPLICATIONS

This application claims priority to U.S. Provisional Application No. 62/099,504 filed Jan. 4, 2015, which is hereby incorporated herein by reference.

BACKGROUND

The present invention relates generally to diaphragms and specifically to microphone diaphragms. Microphones typically comprise acoustic-to-electric transducers or sensors that convert sound into an electrical signal. Microphones typically include a pressure sensitive diaphragm that is utilized to convert sound to mechanical motion, which can subsequently be converted to an electrical signal. Microphone varieties are typically categorized by the transducer type that is incorporated therein, for example, condenser, dynamic, ribbon, carbon, piezoelectric, fiber optic, liquid, pressure-gradient, and microelectric-mechanical system (MEMS). In certain microphones, the diaphragm can be positioned between a fixed internal volume of air and the environment, which allows the microphone to respond uniformly to pressure from a plurality of directions. In other microphones, the diaphragm can be at least partially open on both of its sides, which can result in pressure differences between the two sides that gives the microphones directional characteristics.

DETAILED DESCRIPTION

Figure 1:
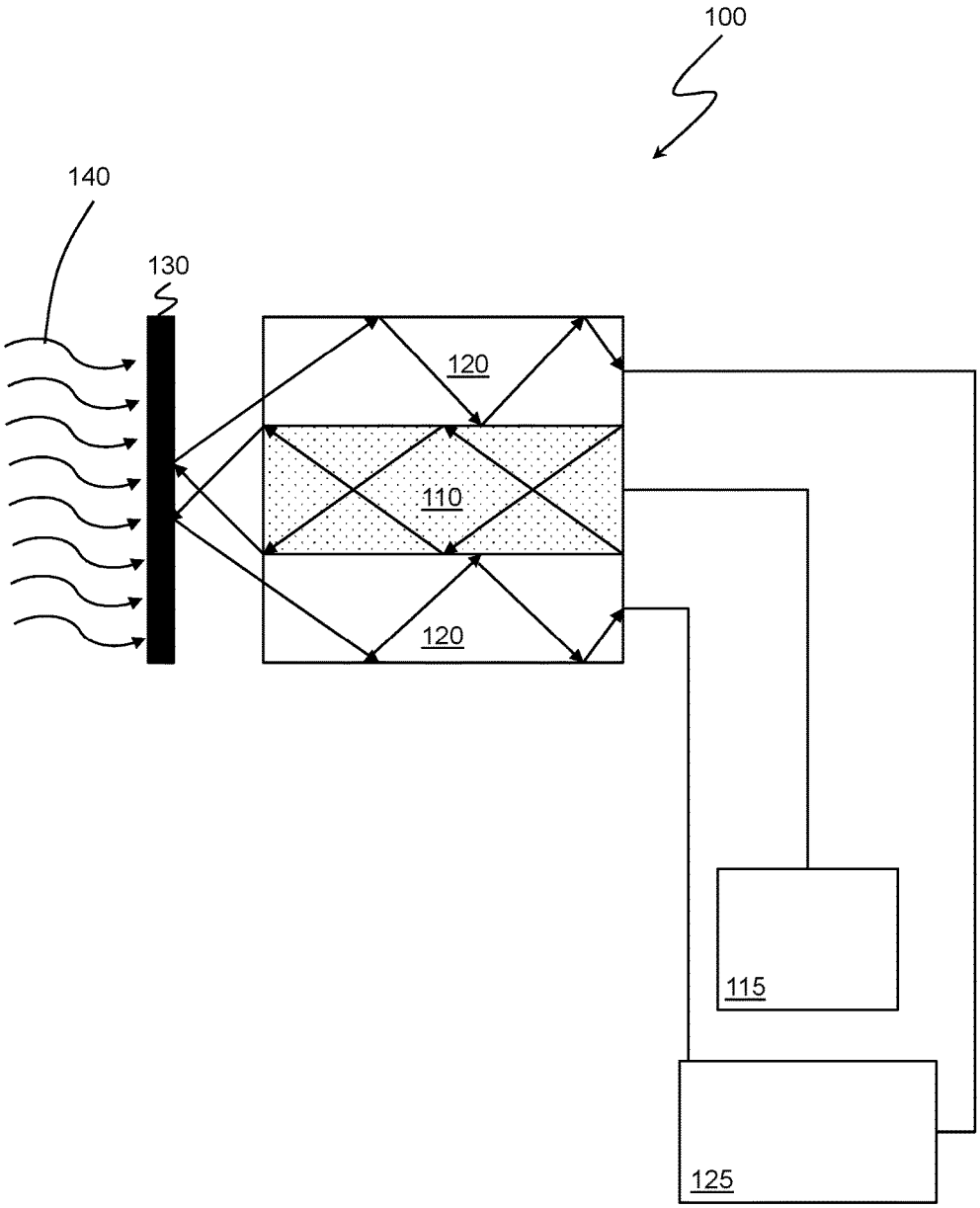
FIG. 1 depicts a sensor, generally 100, in accordance with an embodiment of the present invention.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Certain terminology may be employed in the following description for convenience rather than for any limiting purpose. For example, the terms "forward" and "rearward," "front" and "rear," "right" and "left," "upper" and "lower," and "top" and "bottom" designate directions in the drawings to which reference is made, with the terms "inward," "inner," "interior," or "inboard" and "outward," "outer," "exterior," or "outboard" referring, respectively, to directions toward and away from the center of the referenced element, the terms "radial" or "horizontal" and "axial" or "vertical" referring, respectively, to directions or planes which are perpendicular, in the case of radial or horizontal, or parallel, in the case of axial or vertical, to the longitudinal central axis of the referenced element, and the terms "downstream" and "upstream" referring, respectively, to directions in and opposite that of fluid flow. Terminology of similar import other than the words specifically mentioned above likewise can to be considered as being used for purposes of convenience rather than in any limiting sense.

In the figures, elements having an alphanumeric designation may be referenced herein collectively or in the alternative, as will be apparent from context, by the numeric portion of the designation only. Further, the constituent parts of various elements in the figures may be designated with separate reference numerals which shall be understood to refer to that constituent part of the element and not the element as a whole. General references, along with references to spaces, surfaces, dimensions, and extents, may be designated with arrows. The term "axis" may refer to a line or to a transverse plane through such line as will be apparent from context.

Microphones typically comprise acoustic-to-electric transducers or sensors that convert sound into an electrical signal. Microphones typically include a pressure sensitive diaphragm that can convert sound to mechanical motion, which can subsequently be converted to an electrical signal. Microphone varieties are typically categorized by the transducer type that is incorporated therein, for example, condenser, dynamic, ribbon, carbon, piezoelectric, fiber optic, liquid, pressure-gradient, and micro-electro-mechanical-system (MEMS) microphones. In certain microphones, the diaphragm can be positioned between a fixed internal volume of air and the environment, which allows the microphone to respond uniformly to pressure from a plurality of directions. In other microphones, the diaphragm can be positioned in a manner to be at least partially open on both of its sides, which can result in the formation of pressure differences between the two sides of the diaphragm and results in directional detection characteristics.

As used herein, the term microphone and sensor are interchangeable and both denote an electrical device that detects acoustic pressure waves. Embodiments of the present invention seek to provide microphone diaphragms that comprise a graphene-based composition having individual graphene sheets. Still other embodiments of the present invention seek to provide printed microphone diaphragms.

FIG. 1 depicts a sensor, generally 100, in accordance with an embodiment of the present invention. Sensor 100 can be any microphone that comprises a diaphragm, including, but not limited to, condenser, dynamic, ribbon, carbon, piezoelectric, fiber optic, laser, liquid, or MEMS microphones. Diaphragm 130 can be positioned at least partially within a housing (not shown) in a manner to facilitate the detection of acoustic pressure (i.e. sound), for example, pressure wave 140. Diaphragm 130 can be a reflective diaphragm having at least one reflective surface. The reflective surface ca reflect at least a portion of the light transmitted by photo-emitter 110 to photo-collectors 120. Photo-emitter 110 and/or photo-collectors 120 can comprise optical fibers. Sensor 100 can detect pressure wave 140. Pressure wave 140 can cause diaphragm 130 to distort upon impact therewith, which can result in a change in the distance between diaphragm 130 and photo-collectors 120. The change in distance can result in a subsequent modulation in the quantity of light that received by photo-collectors 120.

Sensor 100 has a detectable frequency range that can be increased or decreased increasing, respectively, the thickness (i.e. cross-section) of at least a portion of diaphragm 130. Applicant's experimental evidence reflects that the sensitivity of sensor 100 can be increased by decreasing the thickness of diaphragm 130. However, structural integrity of a typical microphone diaphragm is proportional to its thickness. In the present innovation, the use of individual graphene sheets allows for reduced membrane thickness not typically achieved with compositions lacking individual graphene sheets. As the thickness of diaphragm 130 decreases, the quantity of force that is required by pressure wave 140 to distort diaphragm 130 decreases. As the quantity of force with which pressure wave 140 impacts diaphragm 130 decreases, the thickness of at least a portion of diaphragm 130 can be decreased to facilitate the distortion of diaphragm 130 and detection of pressure wave 140. The aforementioned phenomenon allows for increased sensitivity. Photo-emitter 110 can comprise a fiber optic thread having a photo-emitting first end facing diaphragm 130 and a second end in communication with a photo-source, such as component 115. Component 115 can be an electrical device that can transmit generated light via photo-emitter 110. Photo-collectors 120 can be a fiber optic thread having a photo-collecting first end facing diaphragm 130 and a second end in communication with a photo-detector, such as component 125. Component 125 can be an electrical device that can quantify light received via photo-collectors 120.

Although not shown, components 115 and 125 can be comprised in a single component. Components 115 and/or 125 can be in communication with a computing device that controls the operations thereof. The computing device can convert light signals received by photo-collectors 120 to digital signals for processing. Photo-emitter 110 and photo-collectors 120 can be positioned proximate to diaphragm 130 in a manner to maximize any distortion of diaphragm 130 that results from the impact of pressure wave 140. Photo-emitter 110 can be positioned in a manner to be in approximate alignment with the central axis of the housing and/or diaphragm 130. Photo-collectors 120 can be positioned proximate/adjacent to photo-emitter 110. Photo-collectors 120 can be positioned radially around photo-emitter 110. Photo-collectors 120 can be positioned asymmetrically or symmetrically about the photo emitting end of photo-emitter 110. Photo-collectors 120 can be positioned radially about the photo emitting end of photo-emitter 110. Sensor 100 can comprise one or more copies of photo emitter 110 and/or photo collector 120.

Sensor 100 may have a sensitivity of up to 1100 nm/kPa and/or have an ability to detect acoustic signals having a noise density as low as 60 μPa/√Hz at 10 kHz. The distance of photo-emitter 110 and photo-detectors 120 relative to diaphragm 130 can be the same or different. Diaphragm 130 can be positioned proximate to photo-emitter 110 and/or photo-detectors 120 at a distance of about 50 μm to about 100 μm, about 100 μm to about 150 μm, about 150 μm to about 200 μm, about 200 μm to about 250 μm, about 250 μm to about 300 μm, about 300 μm to about 350 μm, about 350 μm to about 400 μm, about 400 μm to about 450 μm, about 450 μm to about 500 μm, about 500 μm to about 550 μm, about 550 μm to about 600 μm, about 600 μm to about 650 μm, about 650 μm to about 700 μm, about 700 μm to about 750 μm, about 750 μm to about 800 μm, about 800 μm to about 850 μm, about 850 μm to about 900 μm, about 900 μm to about 950 μm, or about 950 μm to about 1000 μm.

Figure 2:
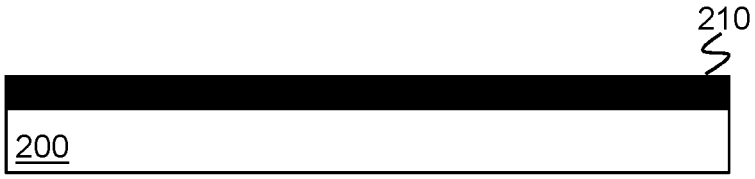
FIG 2 depicts fabrication steps, in accordance with an embodiment of the present invention.
Figure 3:
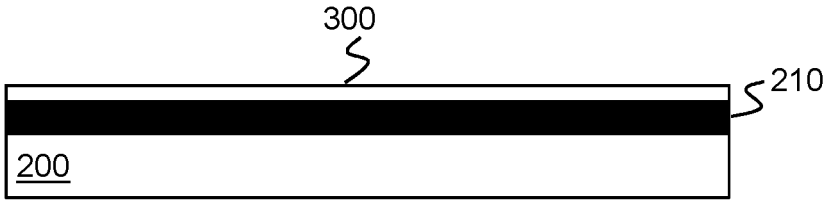
FIG. 3 depicts additional fabrication steps, in accordance with an embodiment of the present invention.
Figure 4:
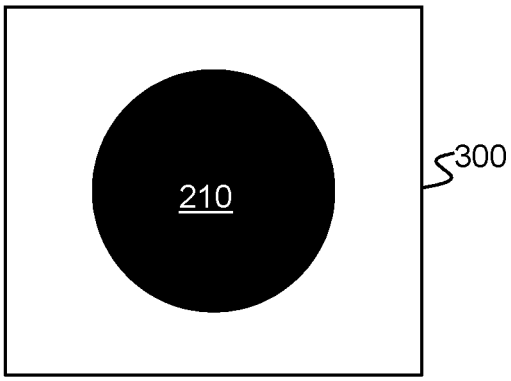
FIG. 4 depicts additional fabrication steps, in accordance with an embodiment of the present invention.
Figure 5:
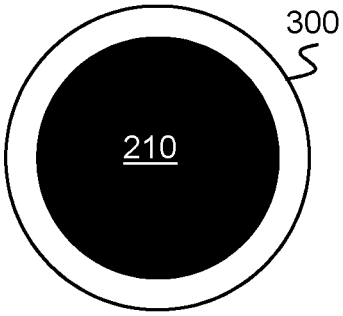
FIG. 5 depicts additional fabrication steps, in accordance with an embodiment of the present invention.

FIGS. 2-4 are disclosed herein to facilitate the discussion of the fabrication of diaphragm 130, in accordance with an embodiment of the present invention. Layer 210 can be formed on at least a portion of the surface of substrate 200. Layer 210 can comprise the composition (discussed above) Layer 300 can be formed on at least a portion of the surface of layer 210 (discussed below). Layer 300 may comprise an opening having a diameter of, for example, about 0.25 inch to about 0.5 inch, about 0.5 inch to about 0.75 inch, or about 0.75 inch to about 1.0 inch. The opening can have a diameter that is a sub-value of any of the aforementioned diameter ranges. Substrate 200 can be subsequently removed from layer 210, which results in the structure of FIG. 4 (a top view of the aforementioned resulting structure). Excess material can be removed from layers 210 and/or 300 to generate a substantially two-dimensional final shape as disclosed in FIG. 5. For example, the final shape and/or opening can be substantially circular, triangular, rectangular, equilateral, trapezoidal, rhombi, or polygonal. Excess material can be removed from lavers 210 and/or 300 to generate an intermediate structure that can undergo additional fabrication steps.

Applicable materials and methods are discussed below, in accordance with an embodiment of the present invention. Layer 210 can comprise a graphene-based composition ("the composition"). The composition can include individual graphene sheets. The individual graphene sheets can be present in the composition in a continuous path established in three dimensions through the FGS by formation of a connected FGS network with nanometer scale separation at the contact point between individual graphene sheets. The graphene sheets and/or composition can be formed utilizing the materials and/or methods that are disclosed in European patent application no. EP20120849213 to Redmond et al., European patent application no, EP20120849443 to Redmond et al., PCT publication no. WO2013074710 A1 to Redmond et al., US patent application Ser. No. 13/284,841, to Scheffer et al., U.S. patent application Ser. No. 12/848,152 to Scheffer et al., U.S. patent application Ser. No. 12/753,870 to Scheffer et al., U.S. PG Pub 2012/0142832 to Varma et al., U.S. patent application publication 2007/0092432 to Prud-'Homme et al., and US patent application Ser. No. 13/140,834 to Scheffer et al. ("the references") (herein incorporated by reference in their entirety). Substrate 200 and/or layer 300 can comprise one or more substrates that are disclosed in the references. Substrate 200 and/or 300 can be formed using one or more methods disclosed in the references.

Layer 210 can be formed in any applicable manner disclosed in the references. For example, layer 210 can be applied to the surface of substrate 200 at a thickness of about 0.5 μm to about 5.0 μm, 0.5 μm to about 0.75 μm, about 0.75 μm to about 1.0 μm, about 1.0 μm to about 1.25 μm, about 1.25 μm to about 1.5 μm, about 1.5 μm to about 1.75 μm, about 1.75 μm to about 2.0 μm, about 2.0 μm to about 2.25 μm, about 2.25 μm to about 2.5 μm, about 2.5 μm to about 2.75 μm, about 2.75 μm to about 3.0 μm, about 3.0 μm to about 3.25 μm, about 3.25 μm to about 3.5 μm, about 3.5 μm to about 3.75 μm, about 3.75 μm to about 4.0 μm, about 4.0 μm to about 4.25 μm, about 4.25 μm to about 4.5 μm, about 4.5 μm to about 4.75 μm, about 4.75 μm to about 5.0 μm, about 5.0 μm to about 10.0 μm, about 10.0 μm to about 15.0 μm, about 15.0 μm to about 20.0 μm, about 20.0 μm to about 25.0 μm, or about 25.0 μm to about 30.0 μm. Applicable thickness values for the composition can include subvalues that are included in the aforementioned thickness ranges.

The applied composition can be cured at about 80° C. to about 85° C., about 85° C. to about 90° C., about 90° C. to about 95° C., about 95° C. to about 100° C., about 100° C. to about 105° C., about 105° C. to about 110° C., about 110°

C. to about 115° C., about 115° C. to about 120° C., about 120° C. to about 125° C., about 125° C. to about 130° C., about 130° C. to about 135° C., about 135° C. to about 140° C., about 140° C. to about 145° C., about 145° C. to about 150° C., about 150° C. to about 155° C., about 155° C. to about 160° C., about 160° C. to about 165° C., about 165° C. to about 170° C., about 170° C. to about 175° C., about 175° C. to about 180° C., about 180° C. to about 185° C., about 185° C. to about 190° C., about 190° C. to about 195° C., about 195° C. to about 200° C. Applicable curing temperatures can include subvalues that are included in the aforementioned curing ranges.

The applied composition can be cured for about 0.5 minutes to about 1.0 minutes, about 1.5 minutes to about 2.0 minutes, about 3.0 minutes to about 3.5 minutes, about 3.5 minutes to about 4.0 minutes, about 4.0 minutes to about 4.5 minutes, about 4.5 minutes to about 5.0 minutes, about 5.0 minutes to about 5.5 minutes, about 5.5 minutes to about 6.0 minutes, about 6.0 minutes to about 6.5 minutes, about 6.5 minutes to about 7.0 minutes, about 7.0 minutes to about 7.5 minutes, about 7.5 minutes to about 8.0 minutes, about 8.0 minutes to about 8.5 minutes, about 8.5 minutes to about 9.0 minutes, about 9.0 minutes to about 9.5 minutes, or about 9.5 minutes to about 10.0 minutes. Applicable curing times can include subvalues that are included in the aforementioned curing time ranges.

Substrate 200 and/or layer 210 can comprise flexible and/or stretchable materials, silicones and other elastomers and other polymeric materials, metals (such as aluminum, copper, steel, stainless steel, and other metals), adhesives, heat-sealable materials (such as cellulose, biaxially oriented polypropylene (BOPP), poly(lactic acid), polyurethanes), fabrics (including cloths) and textiles (such as cotton, wool, polyesters, rayon), clothing, glasses and other minerals, ceramics, silicon surfaces, wood, paper, cardboard, paperboard, cellulose-based materials, glassine, labels, silicon and other semiconductors, laminates, corrugated materials, concrete, bricks, and other building materials. Substrates can in the form of films, papers, wafers, and/or larger three-dimensional objects.

Substrate 200 can comprise materials that are treated with coatings (such as paints) or similar materials before the layer 210 is applied. Coatings can include indium tin oxide, antimony tin oxide, and similar compositions.

One or more surfaces of layers 210 and/or 300 can be coated with a reflective material. The reflective material may comprise a metal. Applicable metals include, but are not limited to, silver, aluminum, lead, gold, platinum, rhodium, copper, magnesium, brass, bronze, titanium, zirconium, nickel, tantalum, tin, nickel, tin, steel, and/or colloidal metals. The reflective material can be applied to at least a portion of the one or more internally-facing (i.e. towards the photo-emitter) surfaces utilizing any of the aforementioned deposition methods. Alternatively, the reflective material is applied to at least a portion of the internally-facing surface of the diaphragm in a manner sufficient to reflect at least a portion of the received light to the photo-collector. The reflective material and/or layer 210 can be deposited using any applicable deposition method, which includes, but is not limited to, spattering, spraying, plating, syringe deposition, spray coating, electrospray deposition, ink-jet printing, spin coating, thermal transfer (including laser transfer) methods, screen printing, rotary screen printing, gravure printing, capillary printing, offset printing, electrohydrodynamic (EHD) printing, flexographic printing, pad printing, stamping, xerography, microcontact printing, dip pen nanolithography, laser printing, via pen or similar means.

In certain embodiments, substrate 200 is a water soluble substrate, such as a water soluble polymer, to reduce the force required to remove diaphragm 210 as well as reduce the probability of reducing the structural integrity of diaphragm 210. The advantage of Applicable water soluble polymers include, but are not limited to, alkaline hydrosoluble copolymers of isobutylene and maleic anhydride, ISOBAM™ (developed by Kuraray Co, LTD), BIOCARE™ polymers (developed by DOW Chemicals), CELLOSIZE™ hydroxyethylcellulose (HEC) (developed by DOW Chemical), DOW™ latex powders (DLP) (developed by DOW Chemical), ETHOCEL™ ethylcellulose polymers (developed by DOW Chemical), KYTAMER™ PC polymers (developed by DOW Chemical), METHOCEL™ water soluble resins (developed by DOW Chemical), POLYOX™ water soluble resins, SoftCAT™ polymers (developed by DOW Chemical), UCARE™ polymers (developed by DOW Chemical), Sokalan® (developed by BASF), Tamol® (developed by BASF), polyacrylamides, polyacrylates, acrylamide-dimethylaminoethyl acrylate copolymers, polyamines, polyethyleneimines, polyamidoamines, polyethylene oxide, rice paper, water soluble paper, ASW-60 (developed by Aquasol Corp.), ASW-35 (developed by Aquasol Corp.), ASW-15 (developed by Aquasol Corp.), ASW-40 (developed by Aquasol Corp.), Dissolov Tech PS (developed by DayMark Technologies), and DissolovTeck 35C (developed by DayMark Technologies), and Ambergum™ water-soluble polymers.

Substrate 200 can be coated with UV-curable water soluble products. Applicable UV-curable water soluble products includes, but is not limited to, Chromafil™ (developed by Chromaline®), CCI Red-Coat (developed by Chemical Consultants, Inc.), isopropanol, Blue Screen Filler No. 60 (developed by Ulano Corp.), Green Extra Heavy Blockout No. 10 (developed by Ulano Corp.), Red Coat Blockout (developed by Lawson Screen Products, Inc.), and Ryo Screen Blockout (developed by Ryonet Corp.).

What is claimed is:

1. A method to fabricate a microphone diaphragm comprising:

forming a first layer on to a surface of a substrate, the first layer comprising individual graphene sheets;

curing the first layer;

forming a second layer on a surface of the first layer;

removing the first layer from the surface of the substrate;

removing excess portions of the first layer and/or the second layer to form a predefined shape; and wherein the individual graphene sheets form a three-dimensional interconnected network in the first layer in a manner wherein individual graphene sheets have nanometer scale separation at contact points between individual graphene sheets.

2. The method to fabricate the microphone diaphragm of claim 1, further comprising:

forming individual graphene sheets from graphite; and wherein the individual graphene sheets have one or more of a surface area of at least 100 $m^2/g$; and a carbon-to-oxygen ratio of at least 1,000:1.

3. The method to fabricate the microphone diaphragm of claim 1, wherein the step of forming the first layer comprises:

preparing a composition comprising a polymer and the individual graphene sheets; and applying the composition to the surface.

4. The method to fabricate the microphone diaphragm of claim 1, wherein the step of forming the first layer comprises:

preparing a composition comprising a reflective material and the individual graphene sheets; and applying the composition to the surface.

5. The method to fabricate the microphone diaphragm of claim 1, wherein the step of forming the first layer on the surface of the substrate comprises electrohydrodynamically printing the first layer on the surface of the substrate.

6. The method to fabricate the microphone diaphragm of claim 1, wherein the step of forming the first layer comprises screen printing the first layer on the surface of the substrate.

* * * * *